US006789890B2

(12) United States Patent
Bruhn et al.

(10) Patent No.: US 6,789,890 B2
(45) Date of Patent: Sep. 14, 2004

(54) HOLDDOWN FOR A HARDCOPY DEVICE

(75) Inventors: Victor H. Bruhn, Vancouver, WA (US); Vance M. Stephens, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 49 days.

(21) Appl. No.: 10/183,827

(22) Filed: Jun. 27, 2002

(65) Prior Publication Data

US 2004/0001132 A1 Jan. 1, 2004

(51) Int. Cl.[7] ..... B41J 2/01
(52) U.S. Cl. ..... 347/104
(58) Field of Search ..... 347/101, 104

(56) References Cited

U.S. PATENT DOCUMENTS 4,660,752 A * 4/1987 Rikard et al. ..... 226/95
5,393,151 A * 2/1995 Martin et al. ..... 400/642
5,419,644 A * 5/1995 Martin et al. ..... 400/642
5,874,979 A * 2/1999 Ohyama ..... 347/104
5,927,877 A * 7/1999 Kelly et al. ..... 400/625
5,992,994 A * 11/1999 Rasmussen et al. ..... 347/104
6,079,888 A * 6/2000 Chen et al. ..... 400/612
6,172,741 B1 1/2001 Wotton et al.
6,224,203 B1 * 5/2001 Wotton et al. ..... 347/101
6,234,472 B1 * 5/2001 Juan ..... 271/194
6,254,090 B1 7/2001 Rhodes et al.
6,270,074 B1 8/2001 Rasmussen et al.
6,679,602 B1 * 1/2004 Bruhn ..... 347/104

FOREIGN PATENT DOCUMENTS

JP 61095966 A * 5/1986 ..... B41J/11/02

* cited by examiner

*Primary Examiner*—Donald P. Walsh
*Assistant Examiner*—M. Kohner

(57) ABSTRACT

A holddown for a hard copy device comprises a member having a surface and plural vacuum zones. Each of the vacuum zones defines a cavity in the surface having at least one port therethrough, and each cavity is defined by a sidewall circumscribing the cavity. At least one of the cavities has sidewall with a first section at a first height relative to the surface and a second section at a second height relative to the surface.

32 Claims, 2 Drawing Sheets

HOLDDOWN FOR A HARDCOPY DEVICE

BACKGROUND

Hard copy devices process images on media, typically taking the form of printers, plotters (employing inkjet or electron photography imaging technology), scanners, facsimile machines, laminating devices, and various combinations thereof, to name a few. These hard copy devices typically transport media in a sheet form from a supply of cut sheets or a roll, to an interaction zone where printing, scanning or post-print processing, such as laminating, overcoating or folding occurs. Often different types of media are supplied from different supply sources, such as those containing plain paper, letterhead, transparencies, pre-printed media, etc.

In some kinds of hard copy apparatus a vacuum apparatus is used to apply a suction or vacuum force to a sheet of flexible media to adhere the sheet to a surface, or to stabilize the sheet relative to the surface, for example, for holding a sheet of print media temporarily to a platen. Such vacuum holddown systems are an economical technology to implement commercially and can improve machine throughput specifications and the quality of the print job. There are a variety of vacuum platen systems.

As wet ink is deposited onto media the surface of the media may be distorted. This distortion of the media that results from interactions between the wet ink and the media, can impact the ability of vacuum holddown systems to reliably stabilize the media, and can likewise have an adverse impact on print quality.

SUMMARY OF THE INVENTION

A holddown for a hard copy device comprises a member having a surface and plural vacuum zones. Each of the vacuum zones defines a cavity in the surface having at least one port therethrough, and each cavity is defined by a sidewall circumscribing the cavity. At least one of the cavities has sidewall with a first section at a first height relative to the surface and a second section at a second height relative to the surface.

DETAILED DESCRIPTION OF PREFERRED EMBODIMENTS

Figure 1:
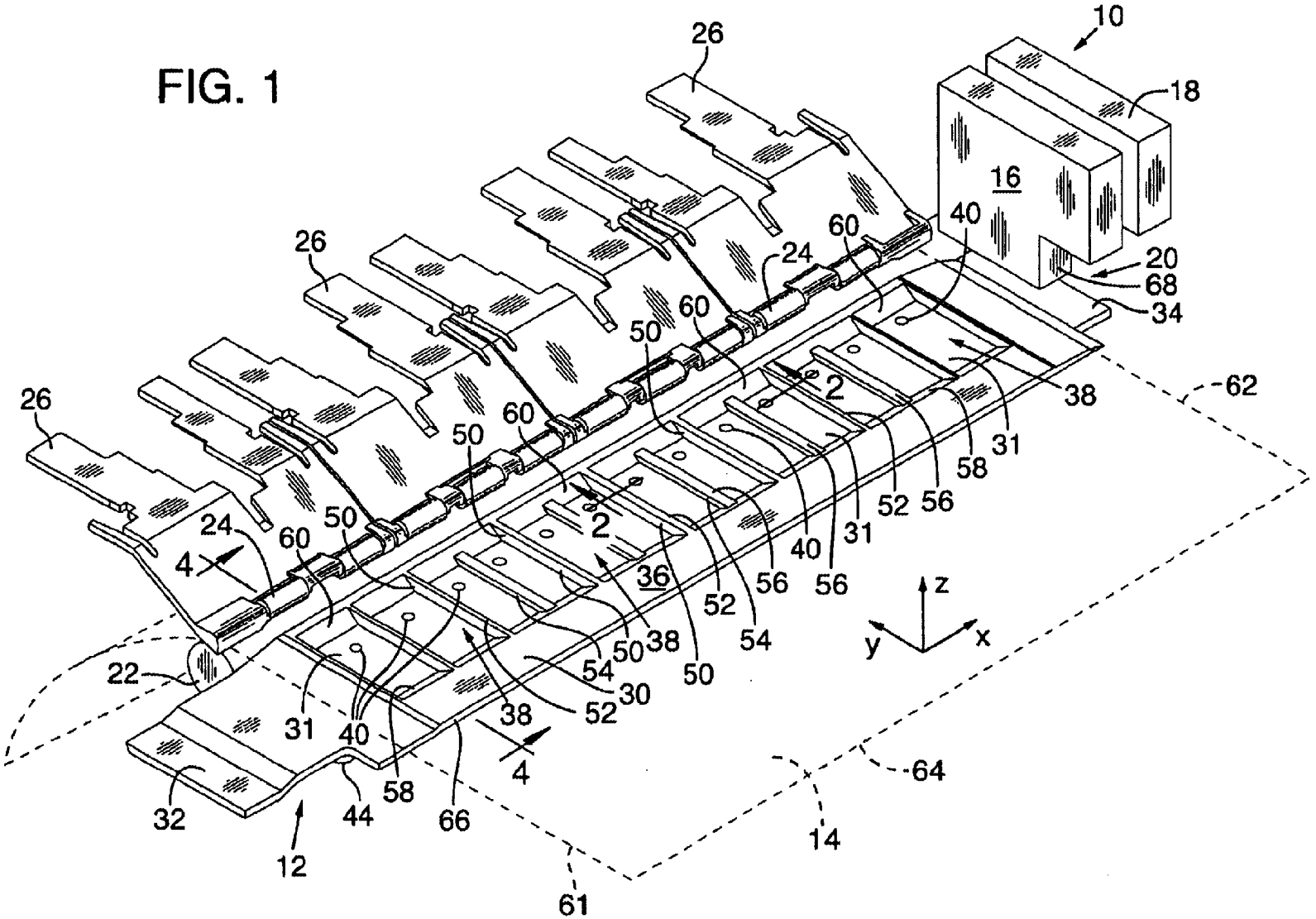
FIG. 1 is a semi-schematic perspective view of selected portions of a hard copy device, here for purposes of illustration an inkjet printer illustrating a vacuum platen according to an illustrated embodiment of the present invention.

Some kinds of hard copy apparatus that employ inkjet printing techniques, such as printers, plotters, facsimile machines and the like, utilize a vacuum device either to support print media during transport to and from a printing station (also known as the "print zone" or "printing zone"), to hold the media at the printing station while images or alphanumeric text are formed, or both. The vacuum device applies vacuum force or suction to the underside of the media to hold the media down, away from the pens, to improve print quality. As used herein, the terms "vacuum force," is used generally to refer to a suction force applied to media. Other terms may be used interchangeably with vacuum force, such "vacuum," "negative pressure," or simply "suction." Moreover, for simplicity in description, the term "media" refers generally to all types of print media, including for example individual sheets of paper or paper supplied in a roll form.

The inkjet printing process involves manipulation of drops of ink, or other liquid colorant, ejected from a pen onto an adjacent media. Inkjet pens typically include a printhead, which generally consists of drop generator mechanisms and a number of columns of ink drop firing nozzles. Each column or selected subset of nozzles selectively fires ink droplets, each droplet typically being only a tiny liquid volume, that are used to create a predetermined print matrix of dots on the adjacently positioned paper as the pen is scanned across the media. A given nozzle of the printhead is used to address a given matrix column print position on the paper. Horizontal positions, matrix pixel rows, on the paper are addressed by repeatedly firing a given nozzle at matrix row print positions as the pen is scanned across the paper. Thus, a single sweep scan of the pen across the paper can print a swath of dots. The paper is advanced incrementally relative to the inkjet printheads to permit a series of contiguous swaths.

Stationary, page-wide inkjet printheads or arrays of printheads (known as "page-wide-arrays" or "PWA") are also used to print images on media, and the illustrated embodiment of a vacuum platen may be utilized in hard copy devices using PWAs.

A phenomenon of wet-colorant printing is "paper cockle." Simply described, cockle refers to the irregular surface produced in paper by the saturation and drying of ink deposits on the fibrous medium. As a sheet of paper gets saturated with ink, the paper grows and buckles, primarily as a result of physical and chemical interactions between the ink and the paper, and the operating conditions that exist in the printer. Paper printed with images has a greater amount of ink applied to it relative to text pages, and is thus more saturated with colorant than simple text pages and exhibits greater paper cockle. Colors formed by mixing combinations of other color ink drops form greater localized saturation areas and also exhibit greater cockle tendencies. Cockle can adversely affect the quality of a print job, and therefore reducing and managing the effects of paper cockle are important in maintaining high quality printing.

As inkjet printheads expel minute droplets of ink onto adjacently positioned print media and sophisticated, computerized, dot matrix manipulation is used to render text and form graphic images, the flight trajectory of each drop has an impact on print quality. Several aspects of ink control can be addressed to improve the quality of a print job and to reduce printing errors. For instance, by controlling the printhead to paper spacing (known as PPS) so that variations in PPS are reduced, randomness in the manner in which ink is deposited can be reduced. Also, if cockle occurs away from the pens, the likelihood of pen to paper contact that can damage the pens and smear images is reduced.

The semi-diagrammatic illustration of FIG. 1 shows pertinent portions of a hard copy device, illustrated for purposes herein as a representative inkjet printer 10 in which an illustrated embodiment of a vacuum platen assembly 12 may be used. For purposes of clarity and to illustrate the embodiments of the invention more clearly, many features of the printer structure and chassis are omitted from the figures. Although the vacuum platen assembly is illustrated with respect to its embodiment in one specific type of printer, the vacuum platen assembly may be embodied in numerous different types of printers and recorders.

Referring to FIG. 1, inkjet printer 10 includes a vacuum platen assembly identified generally with reference number 12. The vacuum platen assembly is mounted in a chassis (not shown) in an operative position to receive recording media 14, such as individual sheets of paper or paper from one or more sources of media such as paper trays. The vacuum platen assembly 12 is mounted adjacent one or more media interaction device(s), here inkjet cartridges 16 and 18, which in a printer are supported by and movable on a shaft (not shown) for reciprocating movement past the media along an axis that extends transverse to the media feed axis. The cartridges 16 and 18 are mounted in a carriage assembly, also not shown, which supports the inkjet cartridges above media 14. A media interaction head, in the case of an inkjet printer a printhead (also not shown) may be attached on the underside of the cartridge. The printhead may be a planar member having an array of nozzles through which ink droplets are ejected onto the adjacent media. The cartridge is supported on the shaft so that the printhead is precisely maintained at a desired spacing from media 14.

The carriage assembly may be driven with a servo motor and drive belt, neither of which are shown, but which are under the control of a printer controller. The position of the carriage assembly relative to print media 14 is typically determined by way of an encoder strip that is mounted to the printer chassis and extends laterally across the media, parallel to the shaft on which the inkjet carriage may be mounted. The encoder strip extends past and in close proximity to an encoder or optical sensor carried on the carriage assembly to thereby signal to the printer controller the position of the carriage assembly relative to the encoder strip.

In FIG. 1, the "X" axis is defined as the axis along which inkjet cartridges 16 and 18 reciprocate on the supporting shaft, which as noted is not shown. The "Y" axis is transverse to the X axis, and is the axis of media travel as the media is fed through a media interaction zone 20, which in the case of an inkjet printer is more specifically identified as a printzone where ink is applied to the media. The "Z" axis in FIG. 1 is the axis that extends vertically upward relative to the ground plane.

As noted, many structural features in the printer are omitted from the drawings to clearly illustrate the embodiment of the invention. For example, printer 10 includes numerous other hardware devices and would of course be mounted in a printer housing with numerous other parts included in the complete printer.

For other hard copy devices, the printer cartridge may be replaced with another type of media interaction head that performs a desired operation on the media in the media interaction zone.

Media 14 is advanced through print zone 20 with a driven linefeed roller 22, which forms a linefeed pinch between the linefeed roller and plural linefeed pinch rollers 24, each of which is mounted on a chassis assembly such as pinch roller guides 26, and which typically would be spring loaded so they are biased against the linefeed roller. The illustrated embodiment of the invention is typically included within a hardcopy device such as a printer that utilizes inkjet printheads to apply ink to the media. With an inkjet printer the media is incrementally advanced through the printzone 20 in a controlled manner and such that the media advances between swaths of the printheads. A disk encoder and associated servo systems are one of the usual methods employed for controlling the precise incremental advance of the media, commonly called "linefeed." Typically, one or more printer controllers synchronize and control linefeed and printhead movement, among other printer operations.

The vacuum platen assembly will now be described in detail. Referring to FIG. 1, vacuum platen assembly 12 comprises a platen plate member 30 that extends laterally across the printer along the X axis and is positioned below the inkjets. The platen plate member 30 is positioned relative to the inkjets 16 and 18 such that it supports the media 14 as the media is advanced past the inkjets. The platen plate member 30 thus defines a support for the media in printzone 20. The outer, opposite ends of plate member 30, labeled 32 and 34, respectively, are mounted to and supported by the printer chassis. The upper surface 36 of platen plate member 30—that is, the surface that faces inkjets 16, 18 (see FIG. 4)—is a substantially planar surface that defines a portion of printzone 20. A plurality of generally rectangular depressions or vacuum zones 38 is formed in plate member 30, arranged in a side-by-side array extending across the plate member. Each vacuum zone 38 is formed as a cavity or depression in the plate member that is recessed relative to the upper surface 36 and, as detailed below, is circumscribed by walls. Each of the individual vacuum zones 38 includes a vacuum passageway or port 40 that extends through a lower surface or floor 31 of each vacuum zone and through platen plate member 30 into a chamber 42 located beneath plate member 30. Chamber 42 fluidly couples the upper surface 36 and vacuum zone 38 with a vacuum source, shown here generically as a vacuum fan 43. The number of ports 40, their size and shape, and their distribution pattern in the vacuum zones 38 may vary depending on the design specifics of a particular implementation. In the illustrated embodiment, the ports 40 comprise an essentially linear array of circular apertures.

In the embodiment illustrated in FIGS. 1 through 5 each vacuum zone is shown as being generally rectangular in shape. It will be appreciated that the geometric configuration of each vacuum zone depends upon many factors such as the type of hardcopy device, the type of platen, etc., and accordingly that that the vacuum zones may be formed in other geometric configurations, including non-rectangular forms and forms defined by curved wall sections.

Figure 4:
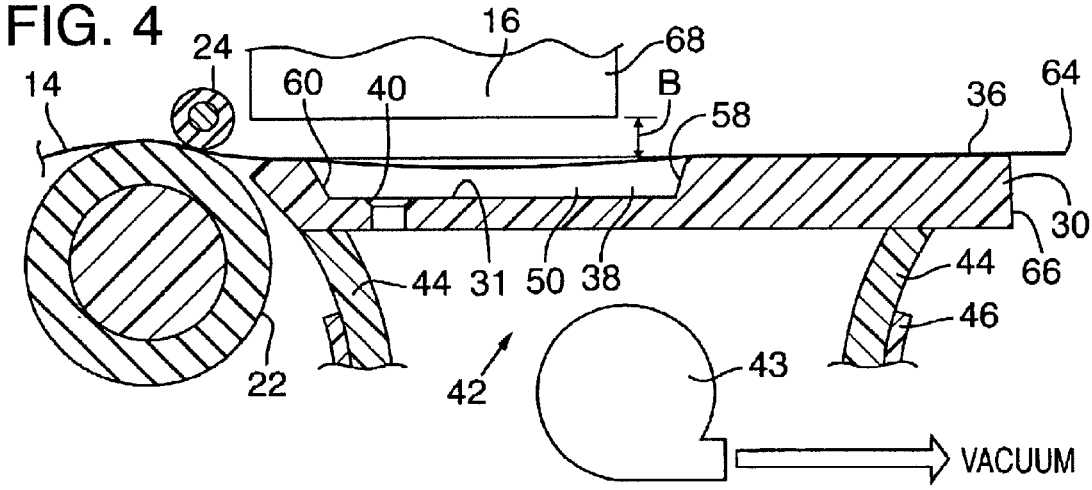
FIG. 4 is a partial cross sectional view of the illustrated embodiment of a vacuum platen taken along the axis that is transverse to the view of FIG. 2, and illustrating a sheet of dry media in the media interaction zone, taken along the line 4—4 of FIG. 1.

With reference to FIG. 4, platen plate member 30 includes a downwardly depending frame member 44 that extends completely around the plate member to define the boundary of chamber 42. Frame member 44 is fluidly sealed to a complementary upwardly extending frame member 46 that communicates with vacuum source 43, which as noted may take the form of a vacuum fan, as shown, or a similar blower, pump or the like. It will be appreciated that vacuum source 43 is illustrated generally and is in fluid communication with chamber 42. The vacuum source may be remotely located for convenience of design. The preferred vacuum source is an electrically operated fan that draws air through ports 40, into chamber 42 and through the fan. Frame members 44 and 46 are preferably interconnected such that they form an airtight seal. Rubber gaskets or O-ring seals and the like may be used to facilitate the seal.

Figure 2:
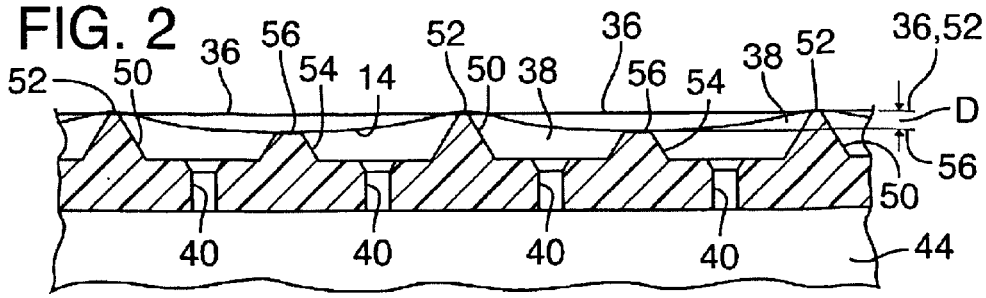
FIG. 2 is partial cross sectional view of the illustrated embodiment of a vacuum platen showing several vacuum zones contained within the platen and illustrating a sheet of dry media supported on the platen, taken along the line 2—2 of FIG. 1.

A rib member separates each vacuum zone 38 from the next adjacent vacuum zone 38 and extends upwardly from floor 31 of the vacuum zones. With reference to FIG. 1, vacuum platen assembly 12 includes two different types of rib members, which differ from one another in their respective heights relative to floor 31. Turning to FIG. 2, the first type, referred to herein as major ribs, are labeled with reference number 50. The major ribs 50 have an upper surface 52 that is coextensive and coplanar with upper surface 36 of platen plate member 30. The second type, referred to herein as minor ribs, are identified with reference number 54. The minor ribs have an upper surface 56 that is below the level of upper surface 36. The "height" of major ribs 50, measured from the floor 31 of a vacuum zone 38 (see FIG. 4), is thus greater than the relative "height" of minor ribs 54. This orientation of the major ribs 50 relative to the minor ribs 54 is shown in FIG. 2, where the level of upper surface 36 is illustrated schematically and where it may be seen that the upper surfaces 52 of major ribs 50 are separated from the upper surfaces of 56 or minor ribs 54 by a distance D.

Again referring to FIG. 1, major ribs 50 may alternate with minor ribs 54. However, as detailed below, printer 10 is designed to accommodate several different sizes of media and it is generally preferred that the lateral media edges rest on a major rib as the media is advanced through the printzone 20, unless the media is of a type that is wide enough that it extends completely across the vacuum zones, as illustrated in FIG. 1. As such, in some instances two major ribs 50 may be located immediately adjacent one another, as illustrated in FIG. 1 with respect to the two major ribs nearest outer end 32 of platen plate member 30.

Each vacuum zone 38 is thus a generally rectangular depression formed in platen plate member 30. Each vacuum zone is defined by a front and rear wall, and by opposed side walls. The front and rear walls of each vacuum zone—front and rear referring to the walls of each vacuum zone that extend in the direction along the X axis, and "front" being the front end of the printer—are labeled with reference numbers 58 and 60, respectively. FIG. 4. Front walls 58 and rear walls 60 are all of the same height and terminate at upper surface 36. The side walls of each vacuum zone—that is, the walls that extend along the Y axis and thus divide one vacuum zone 38 from the next adjacent vacuum zone or zones 38—are defined by ribs 50 and 54, except at the two vacuum zones that are at the outermost lateral ends of the platen, in which case one of the side walls is defined by the wall that defines part of the platen rather than a rib.

The effect of the variable rib heights defined by the major ribs 50 and minor ribs 54 will now be described with reference to a sheet of media 14 as it advances through the printzone 20. Beginning with FIG. 1, media 14 is shown as being a standard sized cut sheet such as an 8½×11 inch sheet of paper. The outer lateral edges of media 14, here labeled 61 and 62, respectively, extend laterally across platen plate member 30 beyond the outermost vacuum zones 38 such that the outer edges of the paper rest on upper surface 36 laterally outwardly of the outermost vacuum zones. It will be appreciated that as noted above, the printer is designed to accommodate several different kinds of media that have several different widths. The media 14 shown in FIG. 1 is one of many kinds of media that may be used with the illustrated embodiment of a vacuum platen, and is shown for illustrative purposes only. The outer edge 62 of the media, regardless of the size of media being used, will usually be aligned on the platen in the position shown in FIG. 1.

Figure 3:
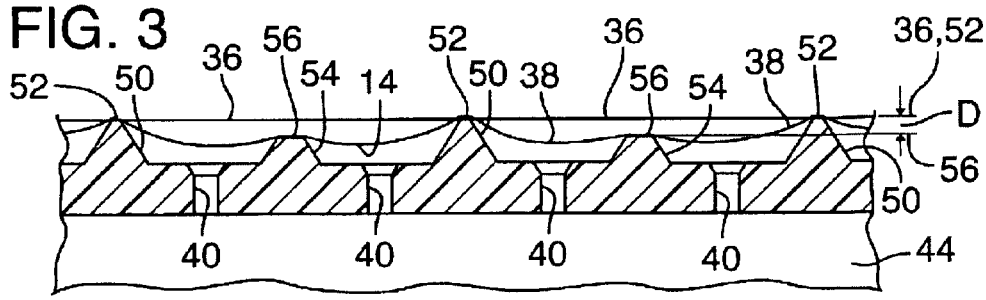
FIG. 3 is a partial cross sectional view of the illustrated embodiment of a vacuum platen showing several vacuum zones contained within the platen and illustrating a sheet of wet media supported on the platen, taken along the line 2—2 of FIG. 1.

The vacuum source 43 is either activated as the leading edge 64 of media 14 is advanced by linefeed roller 22 through printzone 20, or is activated prior to the leading edge entering the printzone to induce a flow of air from the upper surface of the platen into the vacuum zones 38 and through ports 40 into chamber 42. Referring to FIG. 3, linefeed roller 22 feeds media 14 onto upper surface 36 adjacent rear wall 60 so that an effective seal is formed between the media and the vacuum zone as the media advances forwardly enough that the media leading edge travels over the front wall 58 and the media thus covers the entire vacuum zone 38.

FIG. 4 illustrates the vacuum platen assembly 12 when media 14 is present and covers the entire vacuum zone 38 but where no ink has been applied to the media and therefore no ink-induced cockle is occurring in the media. In FIG. 4, the leading edge 64 of media 14 has advanced past the forward edge 66 of platen plate member 30. The vacuum force applied on media 14 causes the media to be deflected downwardly toward the platen, away from the inkjet 16 and effectively forms a sealed chamber in each vacuum zone 38. Application of vacuum force in this manner tends to hold dry media 14 in a relatively flat orientation on platen plate member 30, and therefore controls the printhead to paper spacing so that the distance B in FIG. 4 is relatively constant. When the PPS is controlled, randomness in the manner in which ink droplets are deposited on the media is reduced.

Figure 5:
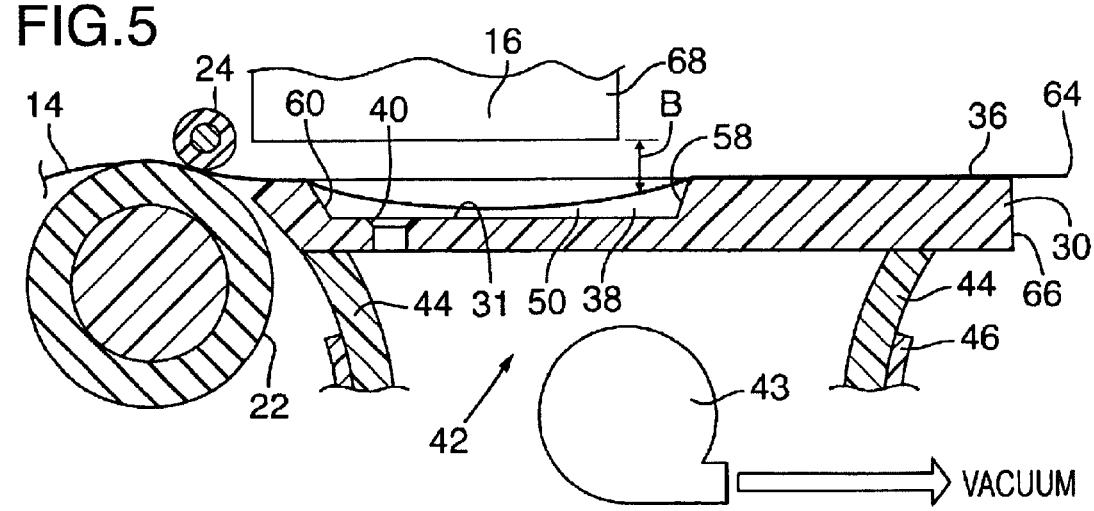
FIG. 5 is a partial cross sectional view as in FIG. 4, and illustrating a sheet of wet media in the media interaction zone after ink has been applied to the media and the media is exhibiting cockle.

FIG. 5 is similar to FIG. 4 except it illustrates a sheet of media 14 onto which ink has been applied, and the media is exhibiting cockle as a result of the interactions between the ink and the media. As cockle is formed in media 14, the vacuum force applied to the media causes the paper to be deflected downwardly into vacuum zones 38 toward floor 31 to a greater extent than shown in FIG. 4. That is, cockle growth occurs in the direction away from the inkjet printheads. Although the cockle results necessarily in slight variations in PPS (distance B) at some points in printzone 20, the application of vacuum insures that cockle growth is away from the inkjet 16. It will be noted that each vacuum zone 38 is wider (in the direction along the Y axis) than the width (along the same axis) of the inkjets 16 and 18. As such, each vacuum zone 38 extends forwardly beyond the forward edge 68 of inkjet 16. Stated in another way, the front wall 58 of each vacuum zone is positioned forward along the Y axis of the forward edge 68 of the inkjet. This spacing provides an additional distance along the vacuum zone that the media 14 may ride over as cockle forms, yet still be exposed to vacuum force.

FIG. 2 is similar to FIG. 4 in that it illustrates media 14 that has no ink applied thereto and is therefore dry, except FIG. 2 is a sectional view taken through several vacuum zones and along the X axis. The vacuum force applied to media 14 causes the media to rest on the upper surfaces 52 and 56 of the alternating major and minor ribs, 50 and 54. It will be appreciated that the amount of downward deflection in media 14 in FIG. 2 (where the media defines a waveform across the platen) is exaggerated to demonstrate that the alternating rib heights between major ribs 50 and minor ribs 54 define a media receiving and supporting surface that holds the media away from the inkjets to maintain and control PPS. Because vacuum force is applied to the underside of media 14, the dry media in FIG. 2 is held downwardly in the direction away from the inkjets. As illustrated in FIG. 1, the alternating rib heights between the upper surfaces 52 of major ribs 50 and adjacent upper surfaces 56 of minor ribs 54 defines a media-supporting surface in the printzone that is non-planar, whereas the upper surface 36 of the platen outside of the vacuum zones is planar.

FIG. 3 is a view comparable to FIG. 2, except that as in FIG. 5, FIG. 3 illustrates media 14 onto which ink has been applied and which as a result is exhibiting cockle. Again, it will be appreciated that the amount of cockle shown in media 14 in FIG. 3 is exaggerated to demonstrate that the alternating rib heights between major ribs 50 and minor ribs 54 define a media receiving and supporting surface that holds the media away from the inkjets to maintain PPS. Because vacuum force is applied to the underside of media 14, cockle growth desirably occurs downwardly, in the direction away from the inkjets.

The non-planar media supporting surface defined by alternating rib heights of the illustrated embodiment allows for increased rib-to-rib spacing between adjacent ribs than if all of the ribs were of the same height. Stated otherwise, a vacuum platen that has ribs that are all of the same height and has the same rib spacing as the illustrated embodiment would require either a greater vacuum force to accomplish the same initial downward bias of dry paper toward the platen, or a higher PPS variation if the same vacuum force were used. By using alternating rib heights and a resulting non-planar media supporting surface, the amount of vacuum force applied may be reduced, thereby lowering the noise levels from the vacuum fans. Moreover, with alternating rib heights, cockle is controlled accurately and the PPS may be decreased, thereby increasing the quality of the print job.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. A holddown for a hard copy device, comprising:

a member having a surface and plural vacuum zones, each of the vacuum zones defining a cavity in said surface having at least one port therethrough, and each cavity defined by a sidewall circumscribing the cavity, and wherein at least one of said cavities has sidewall with a first section at a first height relative to the surface and a second section at a second height relative to the surface.

2. The holddown according to claim 1 including plural side walls each circumscribing one of the plural of the vacuum zones and each having a first section terminating at the surface and having a second section terminating at a height recessed from said surface.

3. The holddown according to claim 2 wherein the vacuum zones are arranged in a side-by-side array.

4. The holddown according to claim 3 wherein each cavity further defines a front wall and back wall terminating at the first height, and opposed side walls, at least one of the side walls terminating at the second height.

5. The holddown according to claim 4 wherein adjacent side walls alternate between side walls terminating at the upper surface and side walls terminating at a height recessed from said upper surface.

6. The holddown according to claim 5 wherein the surface defines a platen having a non-planar surface extending laterally across a printzone.

7. The holddown according to claim 6 including an inkjet operatively positioned relative to the platen and wherein the inkjet has a forward edge that defines a forward edge of the printzone, and wherein the front wall of each vacuum zone is spaced forwardly from said forward edge of said inkjet.

8. The holddown according to claim 7 configured for supporting print media thereon having lateral edges such that each lateral edge is supported on a side wall that terminates at the upper surface.

9. The holddown according to claim 1 further comprising a fan fluidly coupled to said ports.

10. The holddown according to claim 1 further comprising a vacuum source fluidly coupled to said ports and configured for applying vacuum to said media through said ports.

11. The holddown according to claim 1 wherein the opposed side walls are defined by ribs having a rib upper surface, and wherein the rib upper surface of at least one of said ribs is coplanar with the upper surface.

12. A holddown for a hard copy apparatus, comprising:

a platen having an upper surface;

plural vacuum zones in the platen, each comprising a recess in the upper surface and each separated from an adjacent vacuum zone by a major rib or a minor rib, wherein each major rib has an upper surface coplanar with the platen upper surface and each minor rib has an upper surface recessed from the platen upper surface;

a port in each vacuum zone;

a vacuum source fluidly communicating with each port.

13. The holddown according to claim 12 wherein the platen further comprises said vacuum zones arranged on said platen in a side-by-side array and wherein each of said vacuum zones further includes a front wall and a back wall that are coplanar with the platen upper surface.

14. The holddown according to claim 12 wherein said major ribs alternate with said minor ribs between adjacent vacuum zones.

15. The holddown according to claim 14 including at least two adjacent vacuum zones separated from one another by a major rib.

16. The holddown according to claim 15 wherein said major rib that separates the at least two adjacent vacuum zones is positioned on said platen to support a media lateral edge.

17. A method of controlling media cockle, the method comprising:

(a) advancing media through a printzone;

(b) applying ink to the media; and (c) applying suction to a surface of the media such that the media is supported on a media supporting surface defining plural suction zones, each of the zones defining a cavity having a port therethrough, and wherein at least one of the cavities is defined by a sidewall surrounding the cavity having a first section at a first height relative to the surface and a second height relative to the surface.

18. The method of claim 17 wherein each suction zone is a recess in the media supporting surface and wherein each cavity is further defined by a front wall, a back wall, and opposed side walls, at least one of said side walls in at least one of said suction zones defining an upper surface recessed from said media supporting surface, and a port through each suction zone, and wherein applying suction to the surface of the media includes the step of applying vacuum to said media.

19. A holddown for hard copy device, comprising:

media interaction zone means;

means for advancing media through said media interaction zone means;

platen means for supporting said media in said media interaction zone, said platen means having an upper surface and said platen means further defined by a plurality of vacuum zones, each defining a cavity in said upper surface having at least one port therethrough, said cavities separated by major ribs and minor ribs, the major ribs having an upper surface higher than said minor ribs; and vacuum means fluidly coupled to said ports for applying vacuum to said media.

20. The holddown according to claim 19 wherein the platen means includes plural side walls terminating at the upper surface and plural side walls terminating at a height recessed from said upper surface.

21. The holddown according to claim 20 wherein adjacent side wails alternate between side walls terminating at the upper surface and side walls terminating at a height recessed from said upper surface.

22. The holddown according to claim 20 wherein the platen defines a non-planar surface extending laterally across a printzone.

23. The holddown according to claim 22 including an inkjet operatively positioned relative to the platen and wherein the inkjet has a forward edge that defines a forward edge of the printzone, and wherein each vacuum zone further includes a front wall and the front wall of each vacuum zone is spaced forwardly from said forward edge of said inkjet.

24. The holddown according to claim 21 configured for supporting print media thereon having lateral edges such that each lateral edge is supported on a side wall that terminates at the upper surface.

25. The holddown according to claim 19 wherein said vacuum means comprises a fan.

26. The holddown according to claim 19 wherein the vacuum means is configured for applying vacuum to said media through said ports.

27. A hardcopy device, comprising:

a printzone;

a source of media;

a source of ink;

a member for supporting media in the printzone and having a surface and plural vacuum zones, each of the vacuum zones defining a cavity in the surface having at least one port therethrough, and each cavity defined by a sidewall circumscribing the cavity and having a first section at a first height relative to the surface and a second section at a second height relative to the surface; and a vacuum source fluidly coupled to said ports.

28. The hardcopy device according to claim 27 wherein the vacuum zones are arranged in a side-by-side array.

29. The hardcopy device according to claim 28 wherein each cavity further defines a front wall and back wall terminating at the first height, and opposed side walls, at least one of the side walls terminating at the second height.

30. The hardcopy device according to claim 29 wherein the walls that define a cavity define a generally rectangular cavity.

31. The hardcopy device according to claim 29 wherein adjacent side walls alternate between side walls terminating at the upper surface and side walls terminating at a height recessed from said upper surface.

32. The hardcopy device according to claim 29 wherein the source of ink includes an inkjet operatively positioned relative to the member and wherein the inkjet has a forward edge that defines a forward edge of the printzone, and wherein the front wall of each vacuum zone is spaced forwardly from said forward edge of said inkjet.

* * * * *